US008516822B2

(12) United States Patent
Chen et al.

(10) Patent No.: US 8,516,822 B2
(45) Date of Patent: Aug. 27, 2013

(54) ANGLED VANES IN COMBUSTOR FLOW SLEEVE

(75) Inventors: Wei Chen, Greenville, SC (US); Stephen Fulcher, Greenville, SC (US)

(73) Assignee: General Electric Company, Schenectady, NY (US)

( * ) Notice: Subject to any disclaimer, the term of this patent is extended or adjusted under 35 U.S.C. 154(b) by 848 days.

(21) Appl. No.: 12/715,864

(22) Filed: Mar. 2, 2010

(65) Prior Publication Data

US 2011/0214429 A1 Sep. 8, 2011

(51) Int. Cl.
*F02C 1/00* (2006.01)
*F02G 3/00* (2006.01)

(52) U.S. Cl.
USPC ..... 60/752; 60/755; 60/760

(58) Field of Classification Search
USPC ..... 60/752, 753, 754, 755, 756, 757, 60/758, 759, 760
See application file for complete search history.

(56) References Cited

U.S. PATENT DOCUMENTS

| | | | | | |
|---|---|---|---|---|---|
| 2,916,878 | A * | 12/1959 | Wirt | 60/759 |
| 3,840,332 | A * | 10/1974 | Smith | 431/351 |
| 4,211,069 | A | 7/1980 | Kalbfuss | |
| 4,362,500 | A | 12/1982 | Eriksson et al. | |
| 4,628,687 | A | 12/1986 | Strom | |
| 4,719,748 | A | 1/1988 | Davis et al. | |
| 4,872,312 | A * | 10/1989 | Iizuka et al. | 60/760 |
| 4,916,906 | A | 4/1990 | Vogt | |
| 5,033,263 | A * | 7/1991 | Shekleton et al. | 60/800 |
| 5,085,039 | A * | 2/1992 | Shekleton | 60/804 |
| 6,098,397 | A | 8/2000 | Glezer et al. | |
| 6,412,268 | B1 | 7/2002 | Cromer et al. | |
| 6,446,438 | B1 | 9/2002 | Kraft et al. | |
| 7,082,766 | B1 | 8/2006 | Widener et al. | |
| 7,707,835 | B2 * | 5/2010 | Lipinski et al. | 60/752 |
| 8,245,513 | B2 * | 8/2012 | Huth et al. | 60/752 |
| 2003/0010014 | A1 * | 1/2003 | Bland et al. | 60/39.37 |
| 2006/0283189 | A1 | 12/2006 | Lipinski | |
| 2007/0062198 | A1 * | 3/2007 | Huth et al. | 60/752 |
| 2010/0170258 | A1 * | 7/2010 | Chila et al. | 60/755 |

* cited by examiner

*Primary Examiner* — William H Rodriguez
(74) *Attorney, Agent, or Firm* — Nixon & Vanderhye, P.C.

(57) ABSTRACT

A turbine combustor liner assembly includes a combustor liner having upstream and downstream ends; a transition duct attached to the downstream end of the combustor liner; a first flow sleeve surrounding the combustor liner, with a first radial flow passage therebetween; and a first annular inlet at an aft end of the flow sleeve, the inlet provided with a plurality of circumferentially spaced, angled flow vanes arranged to swirl air entering the first radial flow passage via the annular inlet.

20 Claims, 4 Drawing Sheets

ANGLED VANES IN COMBUSTOR FLOW SLEEVE

The present invention relates to gas turbine combustor technology generally and to an air flow arrangement that redirects compressor discharge air to combustor burners through an axially-extending, annular passage radially between a combustor liner and a surrounding flow sleeve with enhanced cooling of the combustor liner and reduced pressure drop.

BACKGROUND OF THE INVENTION

In certain gas turbine combustors, a plurality of openings is provided about a flow sleeve surrounding the combustor liner for injecting air in a generally radial direction through the flow sleeve into an annular passage radially between the flow sleeve and the combustor liner for impingement cooling the liner. The air is radially injected generally normal to a free stream of impingement cooling air flowing within the flow sleeve, originating in a similar axially-connected annular passage radially between a transition duct (which carries the combustion gases from the combustor liner to the turbine first stage) and a surrounding impingement sleeve. This redirected compressor discharge air mixes with fuel at the aft end of the combustor and the fuel/air mixture is then combusted within the liner.

The impingement cooling air injected in the radial direction through the flow sleeve openings and into the free stream has a momentum exchange with the axially flowing air and must be accelerated by the axially flowing free stream air until the cross flowing air reaches the free stream velocity. This process causes an undesirable pressure drop in the flow to the combustor. In order to reduce the pressure drop, the air supply configuration has been altered to introduce the compressor discharge air into the passage substantially in the same axial direction as the air already flowing in the stream. This arrangement, however, results in the injecting flow tending to be sucked onto the outer wall of the passage, i.e., the inner wall of the flow sleeve, a manifestation of the so-called Coanda effect which reduces cooling efficiency.

It would therefore be desirable to inject air other than radially into the flow sleeve passage, but in such a way that the Coanda effect is eliminated or at least minimized, and cooling of the liner is enhanced.

SUMMARY OF THE INVENTION

In accordance with one exemplary but nonlimiting aspect of the invention, there is provided a turbine combustor liner assembly comprising a combustor liner having upstream and downstream ends; a transition duct attached to the downstream end of the combustor liner; a flow sleeve surrounding the combustor liner and establishing a first annular flow passage radially between the combustor liner and the flow sleeve; and a first annular inlet to the first annular flow passage at an aft end of the flow sleeve, the first annular inlet provided with a first plurality of flow vanes arranged circumferentially about the first annular flow passage to swirl air entering the first annular inlet about the combustor liner.

In another exemplary but nonlimiting aspect, the invention provides a turbine combustor liner assembly comprising a combustor liner having upstream and downstream ends; a transition duct attached to the downstream end of the liner; a first flow sleeve surrounding the combustor liner with a first radial flow passage therebetween; a first annular inlet to the first radial flow passage at an aft end of the flow sleeve, provided with a plurality of circumferentially spaced, angled flow vanes arranged to swirl air entering the first radial flow passage via the first annular inlet; an impingement sleeve surrounding the transition duct establishing a second annular flow passage radially between the transition duct and the impingement sleeve and communicating with the first annular flow passage; a second annular inlet to the first annular flow passage upstream of the first annular inlet relative to the direction of flow; the second annular inlet provided with a second plurality of flow vanes arranged circumferentially about the combustor liner to swirl air entering the first annular flow passage through the second annular inlet, the second plurality of flow vanes extending radially between the combustor liner and the impingement sleeve.

In still another exemplary but nonlimiting aspect of the invention, a turbine combustor liner assembly comprising a combustor liner having upstream and downstream ends; a transition duct attached to the downstream end of the liner; a first flow sleeve surrounding the combustor liner with a first radial flow passage therebetween; a first annular inlet to the first radial flow passage at an aft end of the flow sleeve, provided with a plurality of circumferentially spaced, angled flow vanes arranged to swirl air entering the first radial flow passage via the first annular inlet; an impingement sleeve surrounding the transition duct establishing a second annular flow passage radially between the transition duct and the impingement sleeve and communicating with the first annular flow passage; a second annular inlet to the first annular flow passage upstream of the first annular inlet relative to the direction of flow; the second annular inlet provided with a second plurality of flow vanes arranged circumferentially about the first annular flow passage to swirl air entering the first annular flow passage through the second annular inlet; wherein the first plurality of flow vanes extend radially between and are engaged with the flow sleeve and an annular coupling attaching the flow sleeve to an impingement sleeve surrounding the transition duct; wherein the second plurality of flow vanes extend radially between the combustor liner and the impingement sleeve; and wherein each of the first and second pluralities of flow vanes comprises a leading end portion and a trailing end portion, the leading end portion located upstream of the trailing end portion relative to a direction of flow into the first annular flow passage.

The invention will now be described in detail in connection with the drawings identified below.

DETAILED DESCRIPTION OF THE INVENTION

Figure 1:
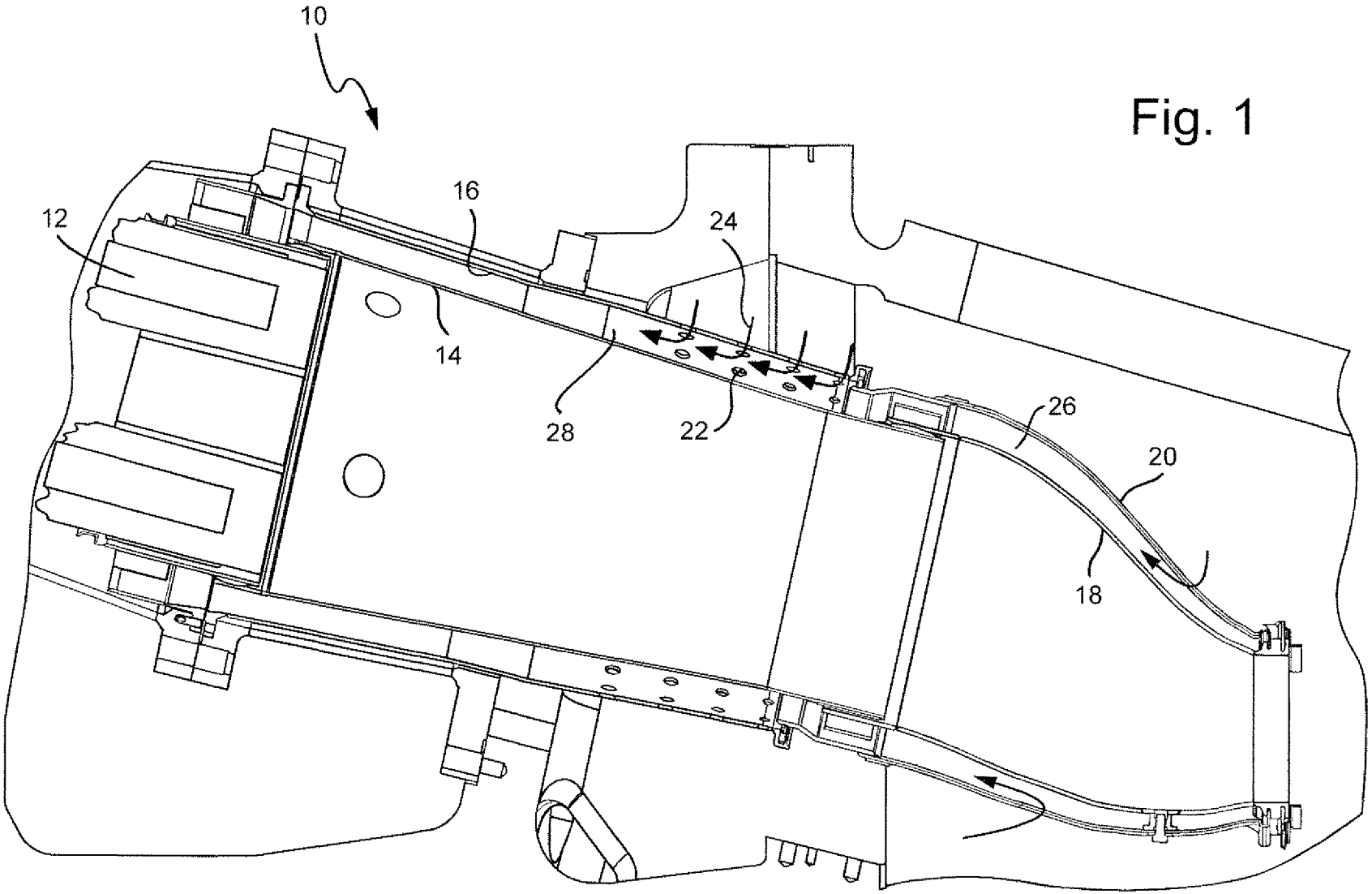
FIG. 1 is a section view of a turbine combustor liner and transition duct assembly.

Referring now to FIG. 1, there is illustrated a combustor 10 for a gas turbine. The combustor 10 includes burners 12 at the aft end of the combustor, a combustor liner 14 and a surrounding flow sleeve 16. A transition piece or duct 18 is connected to the aft end of the liner and an impingement sleeve 20 surrounds the transition piece and is connected to the flow sleeve. It will be appreciated that the area surrounding the flow sleeve 14 and the impingement sleeve 20 is supplied with compressor discharge air which in turn flows through openings (not shown) in the impingement sleeve 20 and openings 22 in the flow sleeve where it is redirected or reverse-flowed in a generally axial flow direction toward the aft end of the combustor within the axially-connected annular passages 26, 28. The supplied air mixes with the fuel in the burners 12, and the fuel/air mixture combusts within the liner 16. The combustion gases flow through the transition piece 18 to the first stage of the turbine (not shown).

As illustrated in FIG. 1, compressor discharge air indicated by the arrows 24 is supplied through the openings 22 in a generally radially inward direction. It will be understood that openings 22 are provided at axially and circumferentially spaced intervals about the flow sleeve. The radially injected air crosses the flow flowing axially in the passage 28. While the radially injected air affords impingement cooling to the liner, the cross flow results in a net loss of energy.

In another arrangement (not shown), air inlet arrangements have been provided that introduce air into the annular passage 28 in a direction generally parallel to the air flowing in the annular passage. This arrangement, as already noted, results in the injecting flow tending to be sucked onto the outer wall of the passage, i.e., onto the inner surface of the flow sleeve, an undesired manifestation of the so-called Coanda effect which negatively impacts impingement cooling of the liner 14.

Figure 2:
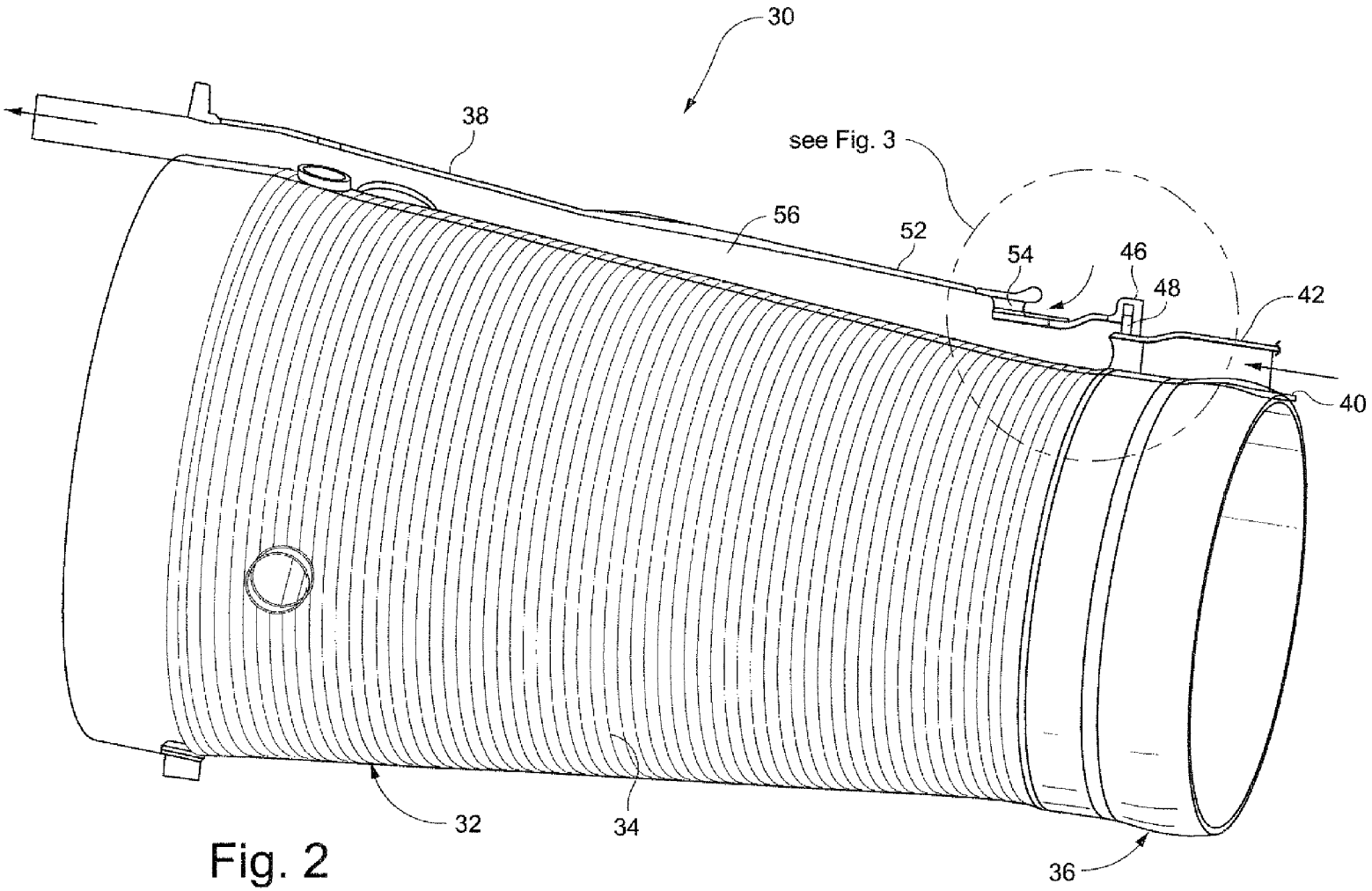
FIG. 2 is a perspective view of a combustor liner, partially cut away and showing the interface between the flow sleeve and axially adjacent transition piece impingement sleeve in accordance with an exemplary but nonlimiting embodiment of the invention.
Figure 3:
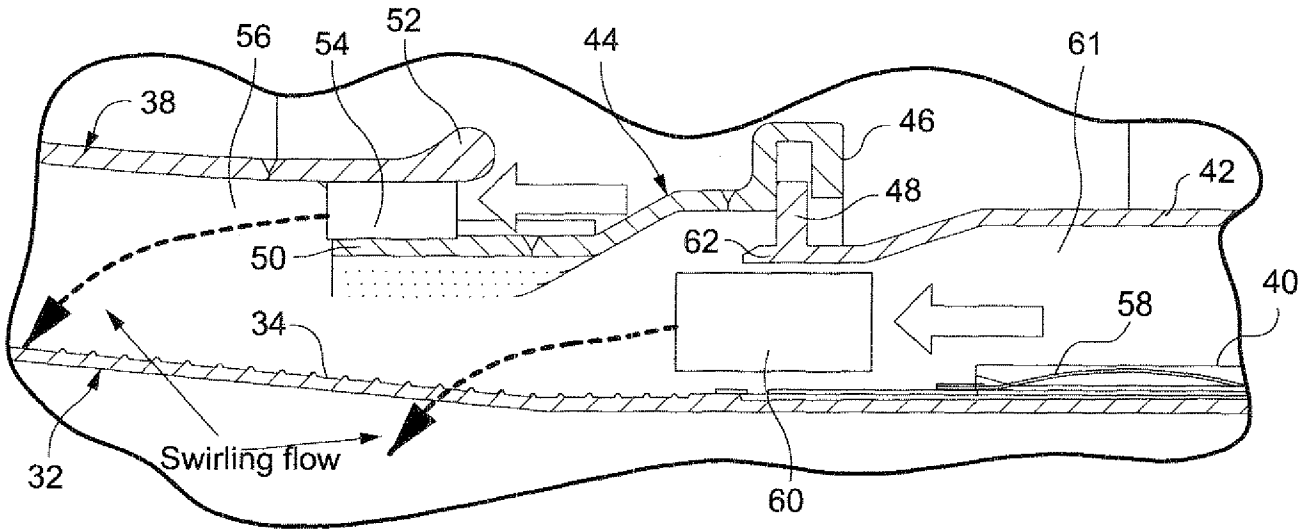
FIG. 3 is an enlarged detail taken from FIG. 2.

Referring now to FIG. 2, a combustor 30 in accordance with an exemplary but nonlimiting embodiment of the invention includes a combustor liner 32 having an outer surface, optionally provided with a plurality of turbulators which may be in the form of axially-spaced rows of shallow ribs 34 (shown schematically) as more clearly seen in FIG. 3. An aft end 36 of the liner is provided with a conventional hula seal assembly 58 by which the liner is sealingly engaged with a transition piece or duct 40, similar to the transition piece 18 shown in FIG. 1.

The combustor liner 32 is surrounded by a flow sleeve 38 (with no cooling holes as in the flow sleeve 16) and the transition piece 40 is surrounded by an impingement sleeve 42. The flow sleeve 38 and impingement sleeve 42 are connected by an annular coupling 44 best seen in FIG. 3. The coupling 44 has a hook portion 46 at its aft end adapted to engage a radial flange 48 on the impingement sleeve 42. The opposite or forward end 50 of the coupling 44 is joined to the aft end 52 of the flow sleeve 38 in the manner described below.

Figure 4:
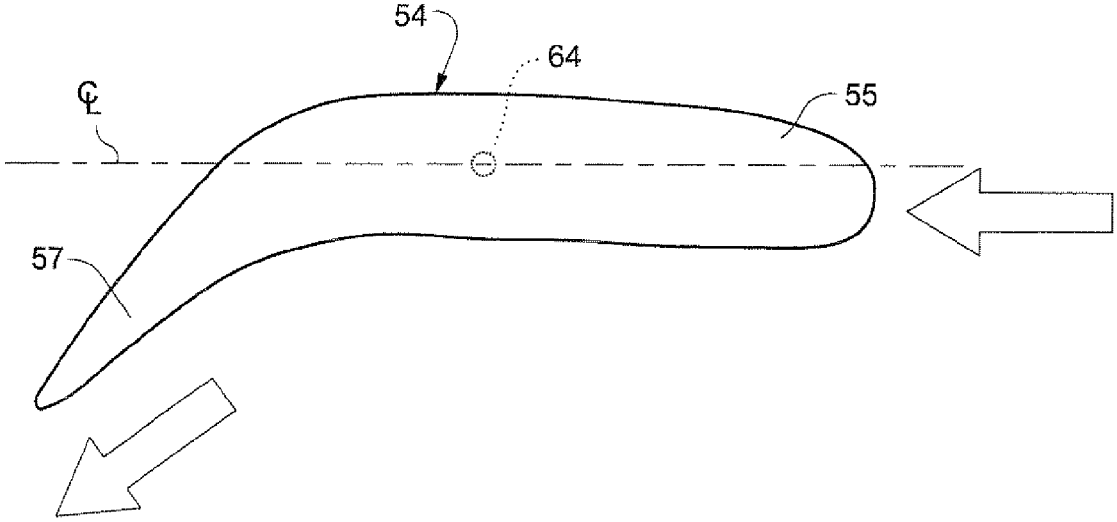
FIG. 4 is a section in plan of a vane utilized at the flow sleeve/impingement sleeve interface of FIGS. 2 and 3.

The forward end 50 of the coupling 44 is attached to the aft end 52 of the flow sleeve by means of a plurality of circumferentially-spaced struts 54 which, in the exemplary but nonlimiting embodiment, are formed as air flow vanes having the shape (in plan) illustrated in FIG. 4. The vanes 54 are arranged such that their leading end portions 55 face the flow as indicated in FIG. 3, with the trailing end portions 57 downstream of the flow. In this exemplary embodiment, the trailing end portion 57 extends at an angle of between about 10° and about 80° relative to an axial center line of the liner. With this arrangement, compressor discharge air external to the flow sleeve 38 and impingement sleeve 42 is free to flow into the passage 56 between the combustor liner 32 and the flow sleeve 38 via the radial space between the aft end 52 of the flow sleeve and the forward end 58 of the coupling 44. The air entering at this location, however, is forced to turn by the angled vanes 54 with the result that the air is swirled about the liner.

At the same time, vanes 60 (also shown schematically) of a similar configuration are interposed between the forward end 62 of the impingement sleeve 42 and the combustor liner adjacent the hula seal 58. These vanes have a similar shape and thus swirling effect on the air flowing axially from the passage 61 between the impingement sleeve 42 and the transition piece 40 and into the passage 56.

In those instances where all of the supporting struts between the coupling 44 and flow sleeve 38 are in fact flow vanes 54, the flow vanes are fixed (e.g., welded), with no individual adjustment capability. In those instances, however, where the flow vanes are combined (for example, alternated) with fixed, radial struts, the flow vanes 54 may be individually or collectively adjustable about radially extending pivot pins 64, as shown in phantom in FIG. 3. By making the flow vanes adjustable, the degree of swirl can be varied as desired. This same arrangement is possible with the flow vanes 60 extending between the impingement sleeve 42 and transition piece 40.

It will also be appreciated that the combustion gases in the liner will swirl in a given direction, creating hot spots in the liner wall as a function of that gas flow. With this invention, the adjustable flow vanes 54 allow the cooling air to be flowed angularly in a swirling direction opposite the swirling direction of the gases within the liner, thus enhancing heat transfer while cooling the hot spots.

With further reference to FIG. 3, the coupling 44 may be modified as needed to, for example, adjust the radial location of the forward end of the coupler relative to the aft end 52 of the flow sleeve 38. As shown in phantom, the forward end may be offset to increase or decrease the opening size and thus the volume of air passing the vanes 54 and flowing into the annular space 56.

Figure 5:
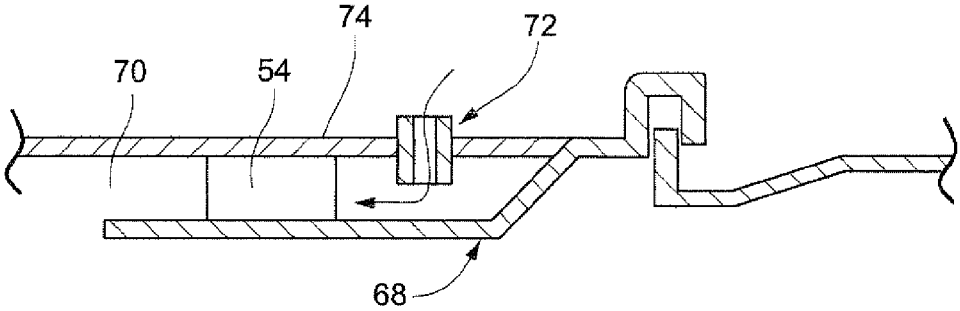
FIG. 5 is a detail similar to FIG. 3 but illustrating an alternative but nonlimiting embodiment.

As shown in FIG. 5, a coupling 68 is configured to have the compressor discharge air enter the annular space 70, across the vanes 54, by means of discrete, circumferentially spaced tubes or transfer elements 72. This arrangement permits better control of the volume of air entering the passage 70 by varying the size (diameter) and number of tubes or transfer elements 72 about the circumference of the flow sleeve 74. If desired, the transfer elements or tubes 72 may be angled to substantially match the trailing end portions 57 of the vanes 54.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine combustor liner assembly comprising:

a combustor liner having upstream and downstream ends;

a transition duct attached to the downstream end of the combustor liner;

a flow sleeve surrounding said combustor liner and establishing a first annular flow passage radially between said combustor liner and said flow sleeve; and a first annular inlet to said first annular flow passage at an aft end of said flow sleeve, said first annular inlet provided with a first plurality of flow vanes arranged circumferentially about said first annular flow passage to swirl air entering said first annular inlet about said combustor liner.

2. The combustor liner assembly according to claim 1 wherein said first plurality of flow vanes extend radially between and are engaged with said flow sleeve and an annular coupling attaching said flow sleeve to an impingement sleeve surrounding said transition duct.

3. The combustor liner assembly according to claim 1 wherein each of said first plurality of flow vanes comprises a leading end portion and a trailing end portion, said leading end portion located upstream of said trailing end portion relative to a direction of flow into said first annular inlet.

4. The combustor liner assembly according to claim 3 wherein said trailing end portion extends at an angle of between about 10° and about 80° relative to an axial center line of said liner.

5. The combustor liner assembly according to claim 1 wherein at least some of said first plurality of flow vanes are adjustable about respective radially oriented pivot axes.

6. The combustor liner assembly of claim 1 further comprising an impingement sleeve surrounding said transition duct establishing a second annular flow passage radially between said transition duct and said impingement sleeve and communicating with said first annular flow passage, a second annular inlet to said first annular flow passage upstream of said first annular inlet relative to said direction of flow; said second annular inlet provided with a second plurality of flow vanes arranged circumferentially about said combustor liner, arranged to swirl air entering said first annular flow passage through said second annular inlet.

7. The combustor liner assembly according to claim 6 wherein at least some of said second plurality of flow vanes are adjustable about respective radially oriented pivot axes.

8. The combustor liner assembly according to claim 7 wherein said first plurality of vanes are angled in a direction to cause air flowing through said first annular inlet to swirl in a direction opposite a swirl direction of combustion gases flowing through said combustor liner.

9. The combustor liner assembly according to claim 1 wherein said first annular inlet is comprised of an annular array of circumferentially spaced tubes extending through said flow sleeve and opening into said first annular passage.

10. The combustor liner assembly according to claim 9 wherein said annular array of circumferentially spaced tubes are angled so as to extend substantially parallel to angled trailing end portions of said first plurality of vanes.

11. A turbine combustor liner assembly comprising:

a combustor liner having upstream and downstream ends;

a transition duct attached to the downstream end of the liner;

a first flow sleeve surrounding said combustor liner with a first radial flow passage therebetween;

a first annular inlet to said first radial flow passage at an aft end of said flow sleeve, provided with a plurality of circumferentially spaced, angled flow vanes arranged to swirl air entering said first radial flow passage via said first annular inlet;

an impingement sleeve surrounding said transition duct establishing a second annular flow passage radially between said transition duct and said impingement sleeve and communicating with said first annular flow passage;

a second annular inlet to said first annular flow passage upstream of said first annular inlet relative to said direction of flow; said second annular inlet provided with a second plurality of flow vanes arranged circumferentially about said combustor liner to swirl air entering said first annular flow passage through said second annular inlet, said second plurality of flow vanes extending radially between said combustor liner and said impingement sleeve.

12. The turbine combustor liner assembly according to claim 11 wherein said first plurality of flow vanes extend radially between and are engaged with said flow sleeve and an annular coupling attaching said flow sleeve to an impingement sleeve surrounding said transition duct.

13. The turbine combustor liner assembly according to claim 11 wherein each of said first and second pluralities of flow vanes comprises a leading end portion and a trailing end portion, said leading end portion located upstream of said trailing end portion relative to a direction of flow into said first annular flow passage.

14. The turbine combustor liner assembly according to claim 11 wherein said trailing end portion extends at an angle of between about 10° and about 80° relative to an axial center line of said liner.

15. The turbine combustor liner assembly according to claim 11 wherein at least some of said first plurality of flow vanes are adjustable about respective radially oriented pivot axes.

16. The turbine combustor liner assembly according to claim 11 wherein at least some of said second plurality of flow vanes are adjustable about respective radially oriented pivot axes.

17. The turbine combustor liner assembly according to claim 11 wherein said first plurality of vanes are angled in a direction to cause air flowing through said first annular inlet to swirl in a direction opposite a swirl direction of combustion gases flowing through said combustor liner.

18. The turbine combustor liner assembly according to claim 11 wherein said first annular inlet is comprised of an annular array of circumferentially spaced tubes extending through said flow sleeve and opening into said first annular passage.

19. The turbine combustor liner assembly according to claim 18 wherein said annular array of circumferentially spaced tubes are angled so as to extend substantially parallel to angled trailing end portions of said first plurality of vanes.

20. A turbine combustor liner assembly comprising:

a combustor liner having upstream and downstream ends;

a transition duct attached to the downstream end of the liner;

a first flow sleeve surrounding said combustor liner with a first radial flow passage therebetween;

a first annular inlet to said first radial flow passage at an aft end of said flow sleeve, provided with a plurality of circumferentially spaced, angled flow vanes arranged to swirl air entering said first radial flow passage via said first annular inlet;

an impingement sleeve surrounding said transition duct establishing a second annular flow passage radially between said transition duct and said impingement sleeve and communicating with said first annular flow passage;

a second annular inlet to said first annular flow passage upstream of said first annular inlet relative to said direction of flow; said second annular inlet provided with a second plurality of flow vanes arranged circumferentially about said first annular flow passage to swirl air entering said first annular flow passage through said second annular inlet;

wherein said first plurality of flow vanes extend radially between and are engaged with said flow sleeve and an annular coupling attaching said flow sleeve to an impingement sleeve surrounding said transition duct;

wherein said second plurality of flow vanes extend radially between said combustor liner and said impingement sleeve; and wherein each of said first and second pluralities of flow vanes comprises a leading end portion and a trailing end portion, said leading end portion located upstream of said trailing end portion relative to a direction of flow into said first annular flow passage.

* * * * *